United States Patent [19]

Rochard et al.

[11] Patent Number: 4,644,670

[45] Date of Patent: Feb. 24, 1987

[54] MANIPULATION LEVER FOR CLOSING AND LATCHING OF A REAR-ENTRY SKI BOOT

[75] Inventors: Jean-Claude Rochard, Annecy-Le-Vieux; Norbert Kopp, Chavanod, both of France

[73] Assignee: Salomon S.A., Annecy, France

[21] Appl. No.: 732,636

[22] Filed: May 10, 1985

[30] Foreign Application Priority Data

May 18, 1984 [FR] France ..... 84 08600

[51] Int. Cl.[4] ..... A43B 5/04; A43B 11/00

[52] U.S. Cl. ..... 36/117; 36/50; 24/68 SK

[58] Field of Search ..... 36/117–121, 36/105, 50; 24/68 SK, 69 SK, 70 SK, 71 SK

[56] References Cited

U.S. PATENT DOCUMENTS

| | | | |
|---|---|---|---|
| 4,142,307 | 3/1979 | Martin | 36/117 X |
| 4,408,403 | 10/1983 | Martin | 36/117 X |
| 4,539,764 | 9/1985 | Pradier . | |
| 4,557,061 | 12/1985 | Graillat et al. . | |

FOREIGN PATENT DOCUMENTS

| | | | |
|---|---|---|---|
| 2628395 | 12/1977 | Fed. Rep. of Germany | 36/50 |
| 3236259 | 4/1983 | Fed. Rep. of Germany | 36/119 |
| 3319749 | 12/1983 | Fed. Rep. of Germany . | |
| 3342331 | 5/1984 | Fed. Rep. of Germany | 36/117 |
| 3342121 | 6/1984 | Fed. Rep. of Germany | 36/117 |
| 3247516 | 6/1984 | Fed. Rep. of Germany | 36/117 |
| 3442780 | 6/1985 | Fed. Rep. of Germany . | |

*Primary Examiner*—James Kee Chi

*Attorney, Agent, or Firm*—Sandler & Greenblum

[57] ABSTRACT

A manipulation element for closing and latching the rear spoiler of a ski boot onto the lower leg of a skier. The boot includes a cable which attaches the boot to a manipulation element. The manipulation element actuates the cable to close and latch the rear spoiler onto the lower portion of the leg. The manipulation element includes an element for actuating the cable to close and latch the boot. This actuating element is journalled on the rear spoiler, and includes a protective enclosure journalled on the actuating element for at least partially enclosing the cable along at least a portion of the length of the cable to protect the cable from damage.

41 Claims, 4 Drawing Figures

MANIPULATION LEVER FOR CLOSING AND LATCHING OF A REAR-ENTRY SKI BOOT

BACKGROUND OF THE INVENTION

1. Field of the Invention

The present invention relates to a rear-entry type ski boot, and more particularly a manipulation lever for closing and latching the upper of such a rear-entry type ski boot on the skier's lower leg.

2. Description of Background Information

Rear-entry type ski boots comprise an upper journalled at least partially around a horizontal transverse axis passing through a rigid shell base. The upper comprises a rear spoiler which surrounds the rear of the leg and a cuff which surrounds the front of the leg. The rear spoiler is pivoted around a horizontal transverse axis which may coincide with the journal axis of the upper on the shell base. The rear spoiler is linked to the upper and/or to the rigid shell base in such a manner so as to be adapted to pivot backwards away from the cuff to allow entry of the foot into the boot in a rear to front movement.

In order to facilitate placing the foot in the boot in a manner which is effective for skiing and comfortable for the skier, it is necessary to close and latch the upper on the skier's lower leg by latching the rear spoiler to the cuff. To accomplish this, it is conventional in the art to provide a cable for linking the cuff and the rear spoiler so as to close and latch the rear spoiler on the cuff. The ends of the cable are anchored on each lateral side of the cuff by adjustable hooks and clamps which can adjust the position of the anchoring point of the cable on the cuff. The cable then extends on both lateral sides of the rear spoiler through guides. The cable is then attached to a manipulation lever which is journalled on the rear spoiler and which is adapted to be locked in a closed position. In this closed position, the cable is stretched by the manipulation lever so as to close and latch the upper on the skier's lower leg. The manipulation lever comprises a solid plate which can be round or another shape and which occupies at least a substantial portion of the width of the dorsal portion of the rear spoiler. Alternatively, it is known to shape the lever in the shape of a "U" or horseshoe. An adjustment device can be positioned between the arms of this horseshoe shaped lever to provide functions other than the closing of the upper on the lower leg.

In prior art rear-entry type ski boots having such a closure cable, the cable extends along the lateral edges or the exterior edges of the arms of the horseshoe to the lower end of the manipulation lever. As a result, the cable is exposed to certain hazards, such as shocks or snags due to contact with obstacles or diverse objects that occurs during skiing. Moreover, the manipulation lever which closes and latches a first boot on the lower leg of the skier, and which can also function to hold the foot down in the interior of the first boot by a single downward pivoting of the manipulation lever, need not be closed manually by the skier. Rather, the skier can use the bottom of the second boot or the bottom of the ski itself to which the second boot is attached, to downwardly pivot the manipulation lever on the first boot. When the manipulation lever is closed in this fashion, the upward movement of the sole of the second boot or the edge of the ski can quickly damage the exposed closure cable on the first boot. Thus, there is a need for a manipulation lever in which the exposed cable is protected from such hazards.

SUMMARY OF THE INVENTION

It is an object of the present invention to eliminate the vulnerability of the cable for closing and latching the rear spoiler on the cuff by placing the cable in a critical zone which is safe from the hazards described above.

The invention which achieves this objective, in one embodiment, relates to a manipulation element for closing and latching a ski boot. In this embodiment the manipulation element is adapted to be used with a boot that comprises a cable attaching the boot to the manipulation element. This cable comprises a means for closing and latching the boot. In this embodiment, the manipulation element comprises means for actuating the cable to close and latch the boot and at least one protective enclosure means attached to the actuating means for at least partially enclosing the cable along at least a portion of the length of the cable to protect the cable from damage. The actuating means is attached to the boot and the cable is attached to the actuating means. In addition, the at least one protective enclosure means is journalled on the actuating means. Furthermore, the manipulation element can further comprise an elastic means for biasing the at least one protective enclosure means towards the actuating means.

In addition, at least a portion of the at least one protective enclosure means is generally horseshoe-shaped. As a result, this portion of the at least one protective enclosure means comprises two spaced apart arms which are spaced apart by a distance sufficient to accommodate the cable between the arms. Each of the arms comprises an end, and the at least one protective enclosure means is adapted to be positioned in a closed position in which the ends of the arms rests on the surface of the actuating means. In addition, the portion of the surface of the actuating means in contact with the ends of the arms of the at least one protective enclosure means is bevelled. The ends of the arms of the at least one protective enclosure means are also bevelled so that the portion of the surface of the actuating means and the ends of the arms of the at least one protective enclosure means comprise means for guiding and positioning ends of the arms into contact with the bevelled portion of the surface of the actuating means.

In addition, the boot which is adapted to be used with the manipulation element comprises a ramp, and the at least one protective enclosure means is adapted to be positioned in an open position in which a bevelled end of the at least one protective enclosure means comprises means for sliding on the ramp of the boot when the at least one protective enclosure means is in this open position. In one embodiment the at least one protective enclosure means comprises a first end and a second end. The first end comprises the above as mentioned bevelled end which slides on the ramp, and the at least one protective enclosure means is journalled on the actuating means at the second end of the at least one protective enclosure means.

In still another embodiment, the actuating means comprises two lateral edges. Furthermore, the cable extends along each of the two lateral edges of the actuating means. In this embodiment the manipulation element comprises two protective enclosure means, each protective enclosure means being positioned along a different lateral edge of the actuating means to individually protect different portions of the cable.

In still another embodiment, the actuating means comprises a lever having a first and a second end, the first end being journalled on the boot, and the protective enclosure means being journalled on the second end of the lever. In this embodiment, the manipulation lever further comprises a return spring for biasing the protective enclosure means toward the lever.

In addition, the boot which is adapted to be used with this manipulation element can comprise a rigid upper at the shell base. The upper can comprise a cuff and a rear spoiler. This spoiler is journalled around a transverse axis with respect to the shell base. The first end of the lever comprises an upper end journalled on the rear spoiler. In addition, the rear spoiler is adapted to be positioned in an open position for receiving the foot of the skier and is adapted to be positioned in a latched and closed position which the rear spoiler is latched on the cuff and around the lower leg of the skier.

In addition, the boot to be used with this manipulation element can further comprise two lateral anchors each positioned on different lateral sides of the cuff. Each anchor anchors one end of the cable to the cuff. Also, the spoiler can comprise a guide for guiding the cable from the anchors to the manipulation element. Also, the lever can comprise a lower end such that the cable is attached to the lower end of the lever.

In addition, the manipulation lever which is adapted to be used with such a boot further includes at least one protective enclosure means having at least a portion that is generally horseshoe-shaped which comprises two spaced apart arms spaced apart by a distance sufficient to accommodate the cable between these arms. Each of the arms comprises an end and the at least one protective enclosure means is adapted to be positioned in a closed position in which the ends of the arms contact the surface of the lever. The portion of the surface of the lever in contact with the ends of the arms of the at least one protective enclosure means is bevelled, as are the ends of the arms of the at least one protective enclosure means so that the portion of the surface of the lever and the ends of the arms of the protective enclosure means comprise means for guiding and positioning the ends of the arms into contact with the bevelled portion of the surface of the lever.

Furthermore, the boot that is to be used with such a manipulation element further comprises a ramp on the spoiler. The at least one protective enclosure comprises a bevelled end which comprises means for sliding on this ramp when the at least one protective enclosure means is in an open position. Furthermore, the at least one protective enclosure means comprises a first end and a second end. The first end comprises the bevelled end that slides on the ramp and the at least one protective enclosure means is journalled on the lever at its second end. Furthermore, the lever comprises two lateral edges and the cable extends along each of the two lateral edges of the lever. In this embodiment, the manipulation element comprises two protective enclosure means, each being positioned along a different lateral edge of the lever to individually protect different portions of the cable.

In still another embodiment, the manipulation element comprises the above-defined elements in combination with the above-defined boot.

In still another embodiment, the invention comprises a ski boot including an upper, a manipulation element, and a cable. The upper is adapted to be placed in the open position for receiving the foot of the skier and in a closed, latched position. The cable attaches the upper to the manipulation element, and the cable comprises means for closing and latching the upper. The manipulation element comprises means for actuating the cable to close and latch the upper, and at least one protective enclosure means attached to the actuating means for at least partially enclosing the cable along at least a portion of the length of the cable to protect the cable from damage. In this embodiment, the actuating means is attached to the upper and the cable is attached to the actuating means.

The actuating means may comprise a lever having a first end and a second end, with the first end journalled on the upper. In addition, the at least one protective enclosure means is journalled on the second end of the lever. Also, the boot may further comprise a spring for biasing the protective enclosure means toward the lever.

The boot can further comprise a shell base around which the upper is at least partially journalled. In this embodiment, the upper comprises a cuff and a rear spoiler. The rear spoiler is journalled around a transverse axis with respect to the shell base. In addition, the first end of the lever comprises an upper end journalled on the rear spoiler. Also, the rear spoiler is adapted to be positioned in an open position for receiving the foot of the skier, and the rear spoiler is adapted to be positioned in a latched and closed position in which the rear spoiler in latched on the cuff and around the lower leg of the skier.

The boot can further comprise two lateral anchors each positioned on different lateral sides of the cuff. Each anchor anchors one end of the cable to the cuff. In this embodiment, the spoiler comprises a guide for guiding the cable from the anchors to the manipulation element. In addition, the lever comprises a lower end to which the cable is attached.

In addition, at least a portion of the at least one protective enclosure means is generally horseshoe-shaped. This at least a portion of the at least one protective enclosure means comprises two spaced-apart arms spaced apart by a distance sufficient to accommodate the cable between the arms. Each of the arms comprises an end which contacts the surface of the lever when the at least one protective enclosure means is in its closed position.

The portion of the surface of the lever in contact with the ends of the arms of the at least one protective enclosure means is bevelled, as are the ends of the arms themselves so that the portion of the surface of the lever and the ends of the arms of the at least one protective enclosure means comprise means for guiding and positioning the ends of the arms into contact with the bevelled portion of the surface of the lever.

In addition, the spoiler comprises a ramp and the at least one protective enclosure means comprises a bevelled end which comprises means for sliding on the ramp when the at least one protective enclosure means is in an open position.

Furthermore, the at least one protective enclosure means comprises a first and a second end. The first end comprises this bevelled end which slides on the ramp and the at least one protective enclosure means is journalled on the lever at the second end of the at least one protective enclosure means.

The lever comprises two lateral edges and the cable extends along the two lateral edges of the lever. In this embodiment, the manipulation element can comprise two protective enclosure means, each protective enclosure means being positioned along a different lateral edge of the lever to individually protect different portions of the cable.

In still another embodiment, the invention comprises a protective enclosure for protecting a cable adapted to close and latch the spoiler of an upper of a ski boot on the lower leg of the skier. The cable closes and latches the spoiler on the lower leg of the skier in response to the closing of a manipulation lever on the spoiler. Furthermore, the cable is attached to the spoiler and is attached to the manipulation lever at an attachment point. The protective enclosure which is adapted to be used with such a boot comprises means for at least partially enclosing at least a portion of the cable extending between the spoiler and the attachment point to the manipulation lever, and means for journalling the enclosing means on the manipulation element. The protective enclosure can further comprise biasing means for biasing the enclosing means toward the manipulation element. Furthermore, at least a portion of the enclosing means can be generally U-shaped and can comprise two spaced-apart arms for receiving the cable therebetween.

In addition, the manipulation element which is adapted to be used with this protective enclosure can comprise a surface so that the ends of the two spaced-apart arms contact the surface of the manipulation element when the enclosing means is positioned in a closed position. Furthermore, the ends of the two spaced-apart arms can be bevelled, as can a portion of the surface of the manipulation element so that the bevelled arms comprise means for positioning and guiding ends of the two spaced-apart arms onto the bevelled portion of the surface of the manipulation element. Furthermore, the manipulation element that can be used with this protective enclosure can comprise a first end and a second end. The first end of the manipulation lever can be journalled on the rear spoiler and the journalling means of the protective enclosure can be attached to the manipulation lever at the second end of the manipulation lever. In addition, the enclosing means can comprise first and second ends. The journalling means is attached to the first end of the enclosing means. In addition, the spoiler that is used with the protective enclosure means of the present invention can comprise a ramp. The protective enclosure means that is designed to be used with such a boot includes an enclosing means comprising a second bevelled end. In this embodiment, the enclosing means is adapted to be placed in an open position in which the second bevelled end of the closing means contacts the ramp.

In still another embodiment, the present invention includes a protective enclosure defined above in combination with a substantially identical protective enclosure. In this embodiment, the manipulation lever which is to be used with a pair of protective enclosures comprises two lateral sides along which the cable extends. The two protective enclosures are each positioned along the different lateral sides of the manipulation lever for individually protecting different portions of the cable.

BRIEF DESCRIPTION OF THE DRAWINGS

The characteristics of invention and the advantages thereof will become evident in view of the detailed description which follows in connection with the attached drawings in which.

Figure 2:
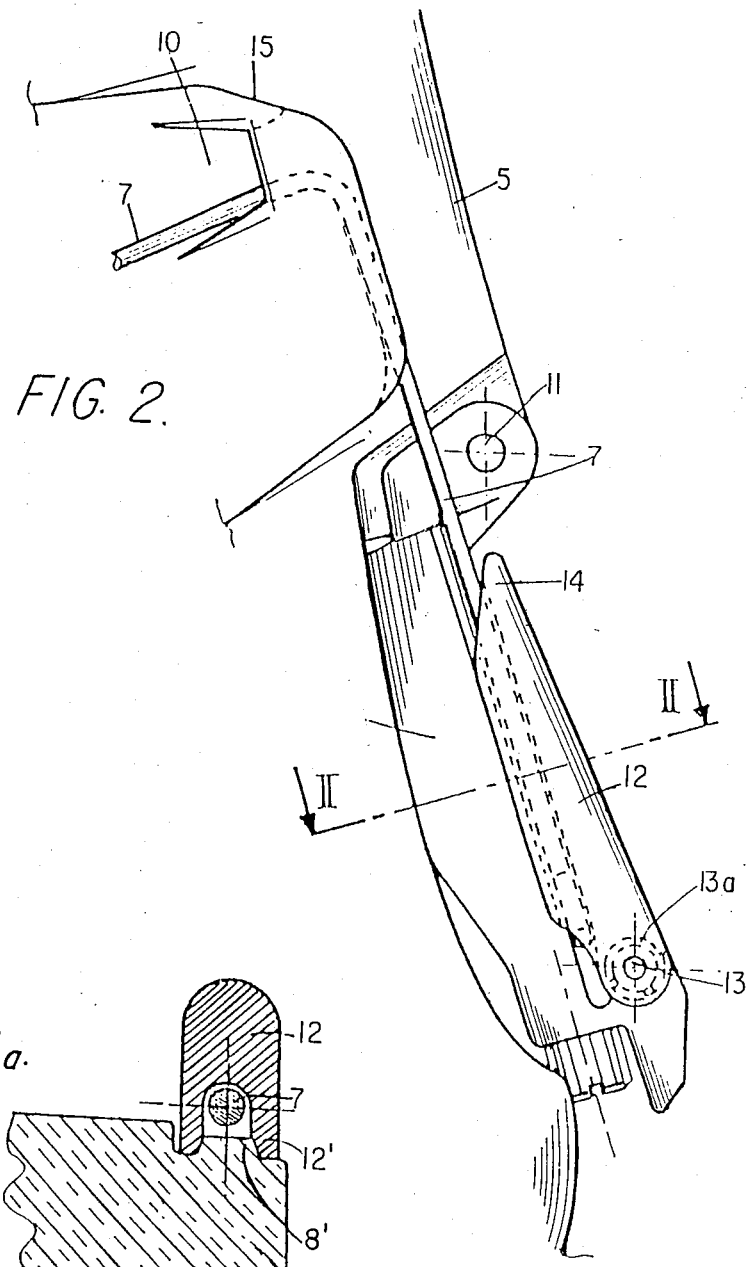
FIG. 2 illustrates a side view of closure/manipulation lever according to the present invention in which the lever is in its latched, closed position.
Figure 3:
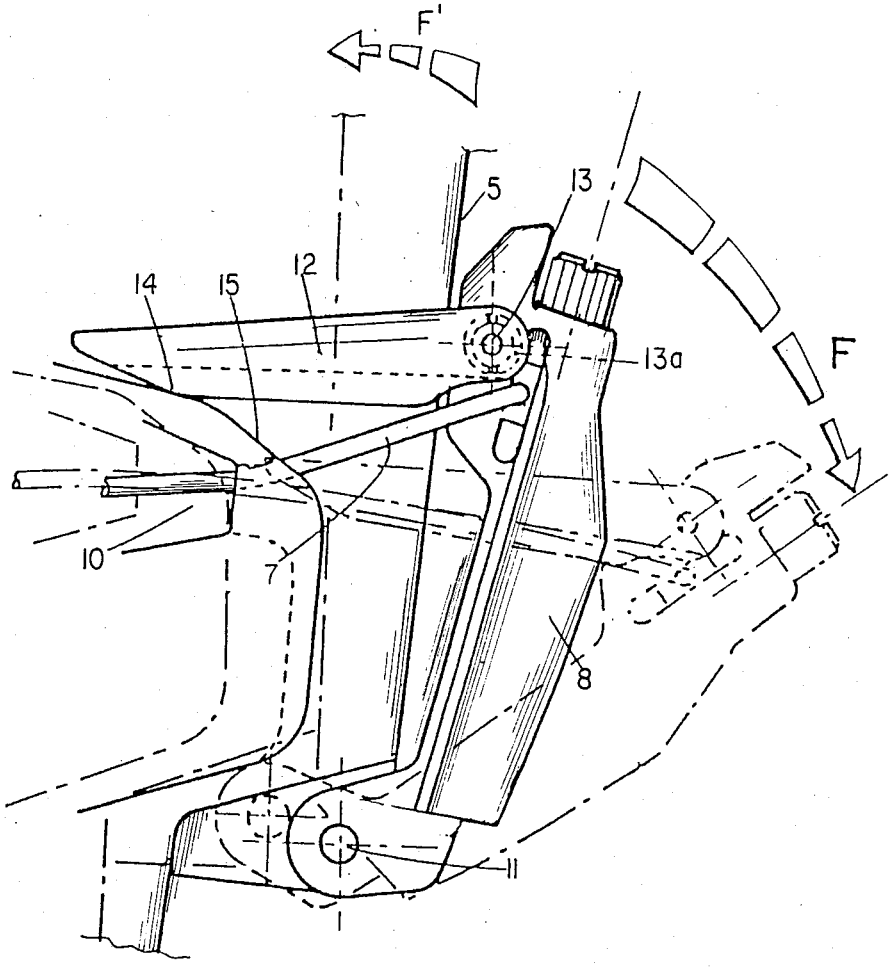

FIG. *2a* illustrates a partial cross-sectional view taken along line II—II of FIG. 2;

FIG. 3 illustrates a side view of the lever in an open and an intermediate position shown in dashed and chained lines during the manipulation of the lever.

DETAILED DESCRIPTION OF PREFERRED EMBODIMENTS

Figure 1:
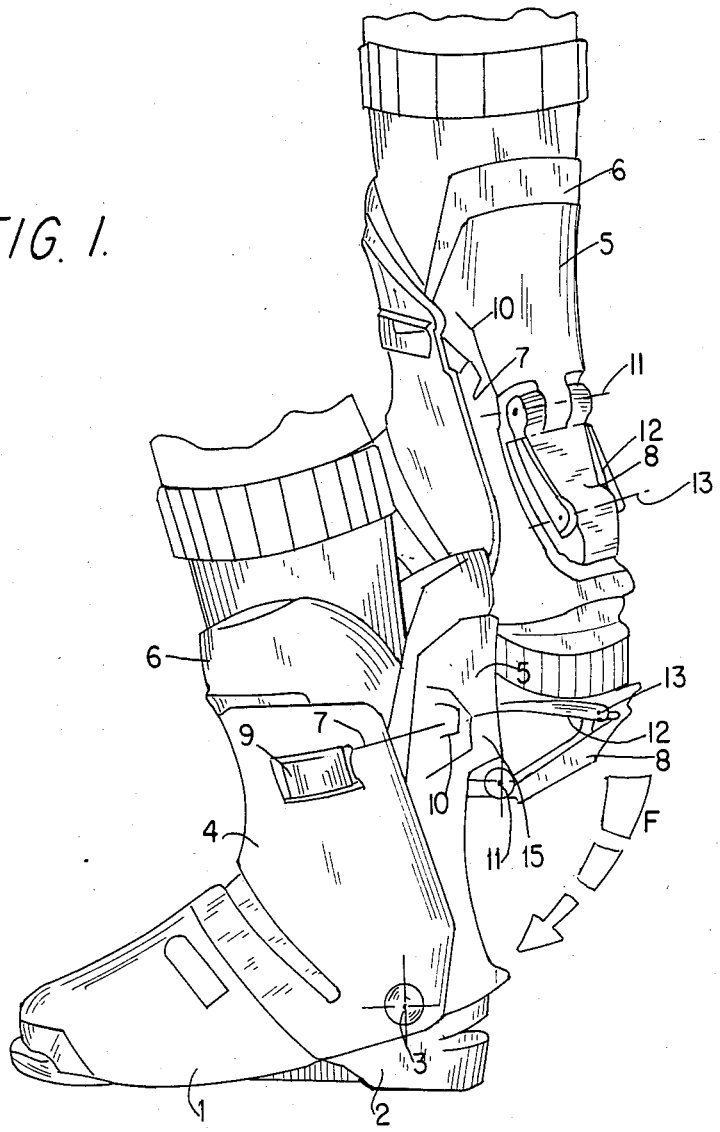
FIG. 1 illustrates a perspective view of the closing of a manipulation lever of the present invention on a first boot by the use of a second boot.

In FIG. 1 two rear-entry type ski boots are shown. Each such boot comprises a one piece rigid shell base 1 including a sole 2. Each boot also comprises an upper journalled on shell base 1 around a transverse axis 3 that is approximately horizontal. The upper comprises a cuff 4 and a rear spoiler 5. In a preferred embodiment the rear-entry ski boots that are illustrated in FIG. 1 also include an interior boot 6 composed of a soft material which is positioned inside shell base 1, cuff 4 and rear spoiler 5.

Rear spoiler 5 is adapted to be displaced into an open position, an intermediate position, and a closed and latched position. In the open position (not shown) rear spoiler 5 is pivoted backwardly in the rearward direction away from cuff 4 so as to permit entry of the foot and lower leg into the boot. In an intermediate position illustrated by the boot in the lower left portion of FIG. 1, rear spoiler 5 is pivoted forward from its open position so as to be adjacent to or in the immediate vicinity of the lower leg of the skier and cuff 4. In its latched position which is forward of the intermediate position, rear spoiler 5 is closed and latched on cuff 4 and on the lower leg of the skier. In this closed and latched position of the rear spoiler 5 the skier can safely ski. This closed and latched position is illustrated by the boot in the upper right portion of FIG. 1.

The closing of the upper and/or rear spoiler 5 on the skier's lower leg is accomplished by the use of a cable 7 and a manipulation lever 8. The ends of cable 7 are laterally anchored on either lateral side of cuff 4 by an adjustable anchoring device 9 that uses, for example, hooks and latches to adjust the position at which cable 7 is anchored on cuff 4 as is known in the art. Alternatively, cable 7 can be guided on or inside cuff 4 while surrounding the rear portion of the wearer's lower leg. From the adjustable anchor device 9, cable 7 extends through lateral guides 10 positioned on either lateral side of spoiler 5. After passing through lateral guides 10, cable 7 then extends downwardly on both lateral sides of the dorsal zone of rear spoiler 5 until cable 7 is anchored to or passes through the lower end of manipulation lever 8.

Manipulation lever 8 is journalled at its upper end on a transverse axis pin 11 supported on rear spoiler 5. Manipulation lever 8 is adapted to be displaced in the direction of arrow F as seen in FIGS. 1 and 3 against the bias of a spring device (not shown).

Manipulation lever 8 is adapted to be positioned in an open position, a series of intermediate positions and a closed, latched position. In the open position, seen in solid lines in FIG. 3, the cable is untensioned to permit movement of rear spoiler 5 into its open and intermediate positions. In the intermediate positions of lever 8, one of which is illustrated in dashed and chained lines in FIG. 3, manipulation lever 8 has been displaced from its open position toward its closed position. In its closed position, illustrated in FIG. 2, lever 8 tensions cable 7 to latch and close spoiler 5 on cuff 4 and on the skier's lower leg.

The operation of the opening and closing of lever 8 (either automatic or manual, depending upon the presence of the spring) and a latching of the manipulation lever to close rear spoiler 5 on cuff 4 is known in itself and in the art and thus, does not require further explanation.

The boot in the upper right portion of FIG. 1 has its rear spoiler already latched and closed upon cuff 4 by the placing of manipulation lever 8 in its closed, latched position. In contrast, the boot in the lower left portion of FIG. 1 has its rear spoiler 5 in an intermediate position in which the spoiler 5 is not yet closed or latched on cuff 4 and therefore, is not yet tightened around skier's lower leg. The closing and latching of spoiler 5 on cuff 4 is accomplished, as illustrated in FIG. 1, by placing the weight of the raised boot in the upper right portion of FIG. 1 on lever 8 of the boot in the lower left portion of FIG. 1 and pressing downwardly in the direction of arrow F. Alternatively, manipulation lever 8 of the boot in the lower left portion of FIG. 1 could be manually moved in the direction of arrow F by the skier's hands. It can be clearly seen from FIG. 1 that if cable 7 were exposed as it traverses lateral portions of lever 8 on the boot in the lower left portion of FIG. 1, cable 7 would be damaged when the boot in the upper right portion of FIG. 1 is pressed downwardly on lever 8 of the boot in the lower left portion of FIG. 1. This damage would occur even more readily if the raised boot were already attached to its ski.

The present invention prevents such damage to cable 7 because cable 7 is protected by a surrounding and protecting enclosure 12. Protecting enclosure 12 is journalled on journal axis pin 13 on lever 8. Journal 13 is positioned in the general vicinity of the lower end of lever 8 near or adjacent to or at the point at which cable 7 is connected and attached to manipulation lever 8. Furthermore, protective enclosure 12 can extend along the entire length of manipulation lever 8 or along a portion of the length of lever 8. Therefore, protective closure 12 can protect cable 7 from damage along the entire length of manipulation lever 8.

In the embodiment illustrated in the drawings, the two portions of cable 7 that extend along opposite lateral edge of manipulation lever 8 are each protected by a different individual protective enclosure 12. However, it is also within the scope of the present invention to use a single protective enclosure for protecting each of these two lateral portions of cable 7 on either lateral side of manipulation lever 8. Such a single protective enclosure would extend across the entire width of lever 8. The entire description of protective enclosure 12 which follows and which is directed to individual enclosures on either lateral side of manipulation lever 8 also applies to such a single protective enclosure without going beyond the scope of the invention.

To summarize, protective enclosure 12 is journalled around a transverse axis 13 on lever 8 adjacent to the free end of lever 8, the free end of lever 8 being defined as the end of lever 8 that is opposite from journal 11. In addition, protective enclosure 12 can extend along the entire length of lever 8 when lever 8 is in the closed position as seen in FIG. 2. Alternatively, enclosure 12 can extend almost the entire length of lever 8 so that enclosure 12 is spaced a small distance from journal 11 which is sufficient to ensure that enclosure 12 does not interfere with journal 11 and journalling of lever 8 on spoiler 5 around journal 11. As a result, protective enclosure 12 extends toward journal 11 of lever 8 on rear spoiler 5 without interfering with the journal 11 and the journalling of lever 8 on rear spoiler 5.

Journal 13 is equipped with a spring 13*a* (seen in dashed lines in FIG. 2) which permanently biases enclosure 12 toward lever 8 and hence, against cable 7 when rear spoiler 5 is in an unlatched position as seen on the boot in the lower left portion in FIG. 1. Moreover, the free end of protective enclosure 12, which is defined as the end opposite from journal 13, has a rounded or bevelled edge 14 which is characterized by an absence of any perpendicular surfaces. This rounded edge 14 is designed to slide on a ramp 15 positioned on rear spoiler 5 above the guides 10 and appears clearly in solid lines in FIG. 3. Rounded edge 14 of enclosure 12 is adapted to slide on ramp 15 without jamming so as to permit unobstructed pivoting of manipulation lever 8 on journal 11.

Figure 2A:
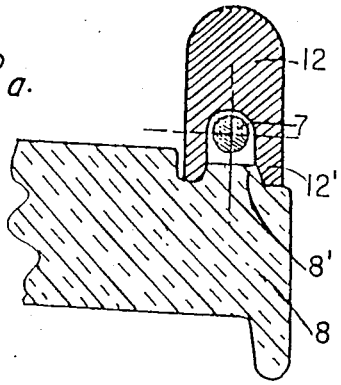

Protective enclosure 12 preferably has a horseshoe-shaped cross-section having two spaced apart arms 12′ as illustrated in FIG. 2*a*. Enclosure 12 is adapted to be positioned in a closed, locked position which is seen in FIGS. 2 and 2*a*. In this locked position, the ends of each arm of enclosure 12 rest on the upper surface 8′ of lever 8 in a manner so as to entirely enclose cover cable 7 so as to protect cable 7 from scraping. The end of the arms of enclosure 12 and that portion of the surface of lever 8 that contacts these arms can both be bevelled for better positioning and guiding the arms of protective enclosure 12 on lever 8.

FIG. 3 ilustrates the displacement of lever 8 from its open position toward its closed position. Between the opened and closed position of lever 8, lever 8 can occupy a plurality of intermediate positions one of which is illustrated in dashed and chained lines in FIG. 3. The position of enclosure 12 when lever 8 is in one intermediate position is also illustrated by dashed and chained lines. The open position of lever 8 is illustrated in solid lines in FIG. 3. When lever 8 is displaced in the direction of arrow F as seen in FIGS. 1 and 3 from its open position to an intermediate position, protective enclosure 12 is biased by its spring 13*a* so that the non-perpendicular edge 14 of enclosure 12 slides on ramp 15 and comes to rest upon the top of cable 7, which is seen in dashed lines in FIG. 3. When edge 14 slides on ramp 15, enclosure 12 is in its open position. Enclosure 12 remains in contact with and encloses at least a portion of cable 7 as lever 8 is displaced from its intermediate positions to its closed, latched position to protect cable 7 while the skier latches the boot and enclosure 12 remains in contact with and encloses cable 7 when the boot is in its closed, latched position to protect cable 7 when the skier skis. During this displacement of lever 8 from its open to its closed position the tension of cable 7 which is anchored at adjustment means 9 on cuff 4, pulls rear spoiler 5 and the journal 11 of lever 8 toward its closed position on cuff 4 which is shown by arrow F′ in FIG. 3.

Based upon the above description, it will be evident that lever 8 which is equipped with protective enclosure 12 permits the full protection of cable 7 at all times both during skiing as well as during the placing of the boot on the foot, or on the ski where the edges of the ski would otherwise quickly damage cable 7.

Although the invention has been described with reference to particular methods, means, and embodiments, it is understood that the invention is not limited to the particulars disclosed but extends to all equivalents within the scope of the claims.

What is claimed is:

1. A manipulation element for closing and latching a ski boot, wherein said boot comprises a cable attaching said boot to said manipulation element, wherein said cable comprises means for closing and latching said boot, wherein said manipulation element comprises:

(a) means for actuating said cable to close and latch said boot, wherein said actuating means is attached to said boot and said cable is attached to said actuating means; and (b) at least one protective enclosure means attached to said actuating means for at least partially enclosing said cable along at least a portion of the length of said cable to protect said cable from damage, wherein said at least one protective enclosure means is journalled on said actuating means, wherein said element further comprises elastic means for biasing said at least one protective enclosure means toward said actuating means.

2. The manipulation element defined by claim 1 wherein at least a portion of said at least one protective enclosure means is generally horseshoe-shaped, wherein said at least a portion of said at least one protective enclosure means comprises two spaced apart arms spaced apart by a distance sufficient to accommodate said cable between said arms.

3. The manipulation element defined by claim 2 wherein each of said arms comprises an end, wherein said at least one protective enclosure means is adapted to be positioned in a closed position in which said ends of said arms rest on the surface of said actuating means.

4. The manipulation element defined by claim 3 wherein the portion of said surface of said actuating means in contact with said ends of said arms of said at least one protective enclosure means is bevelled and wherein said ends of said arms of said at least one protective enclosure means are bevelled so that said portion of said surface of said actuating means and said ends of said arms of said at least one protective enclosure means comprises means for guiding and positioning said ends of said arms into contact with said bevelled portion of said surface of said actuating means.

5. The manipulation element defined by claim 4 wherein said boot comprises a ramp, wherein said at least one protective enclosure means is adapted to be positioned in an open position, wherein said at least one protective enclosure means comprises a bevelled end comprising means for sliding on said ramp of said boot when said at least one protective enclosure means in said open position.

6. The manipulation element defined by claim 5 wherein said at least one protective enclosure means comprises a first end and a second end, wherein said first end comprises said bevelled end, and wherein said at least one protective enclosure means is journalled on said actuating means at said second end.

7. The manipulation element defined by claim 1 wherein said actuating means comprises a lever having a first end and a second end, wherein said first end is journalled on said boot.

8. The manipulation element defined by claims 7, wherein said protective enclosure means is journalled on said second end of said lever.

9. The manipulation element defined by claim 7 wherein said elastic means comprises a return spring for biasing said protective enclosure means toward said lever.

10. The manipulation element defined by claim 9 wherein said boot comprises a rigid upper and a shell base, wherein said upper comprises a cuff and a rear spoiler, wherein said rear spoiler is journalled around a transverse axis with respect to said shell base, wherein said first end of said lever comprises an upper end journalled on said rear spoiler.

11. The manipulation element defined by claim 10 wherein said rear spoiler is adapted to be positioned in an open position for receiving the foot of a skier and said rear spoiler is adapted to be positioned in a latched and closed position in which said rear spoiler is latched on said cuff and around the lower leg of said skier.

12. The manipulation element defined by claim 10 wherein said boot further comprising two lateral anchors each positioned on different lateral sides of said cuff, wherein each anchor anchors one end of said cable to said cuff, wherein said spoiler comprises a guide for guiding said cable from said anchors to said manipulation element, wherein said lever comprises an lower end, wherein said cable is attached to said lower end of said lever.

13. The manipulation element defined by claim 12 wherein at least a portion of said at least one protective enclosure means is generally horseshoe-shaped, wherein said at least a portion of said at least one protective enclosure means comprises two spaced apart arms spaced apart by a distance sufficient to accommodate said cable between said arms.

14. The manipulation element defined by claim 13 wherein each of said arms comprises an end, wherein said at least one protective enclosure means is adapted to be positioned in a closed position in which said ends of said arms contact on the surface of said lever.

15. The manipulation element defined by claim 14 wherein the portion of said surface of said lever in contact with said ends of said arms of said at least one protective enclosure means is bevelled and wherein said ends of said arms of said at least one protective enclosure means are bevelled so that said portion of said surface of said lever and said ends of said arms of said at least one protective enclosure means comprises means for guiding and positioning said ends of said arms into contact with said bevelled portion of said surface of said lever.

16. The manipulation element defined by claim 15 wherein said spoiler comprises a ramp, wherein said at least one protective enclosure means is adapted to be positioned in an open position, wherein said at least one protective enclosure means comprises a bevelled end comprising means for sliding on said ramp when said at least one protective enclosure means in said open position.

17. The manipulation element defined by claim 16 wherein said at least one protective enclosure means comprises a first end and a second end, wherein said first end comprises said bevelled end, and wherein said at least one protective enclosure means is journalled on said lever at said second end.

18. The manipulation element defined by claim 10 wherein said lever comprises two lateral edges, wherein said cable extends along each of said two lateral edges of said lever wherein said manipulation element comprises two protective enclosure means, each protective enclosure means being positioned along a different lateral edge of said lever to individually protect different portions of said cable.

19. The manipulation element defined by claim 18 in combination with said boot.

20. A manipulation element for closing and latching a ski boot, wherein said boot comprises a cable attaching said boot to said manipulation element, wherein said cable comprises means for closing and latching said boot, wherein said manipulation element comprises:

(a) means for actuating said cable to close and latch said boot, wherein said actuating means is attached to said boot and said cable is attached to said actuating means; and (b) at least one protective enclosure means attached to said actuating means for at least partially enclosing said cable along at least a portion of the length of said cable to protect said cable from damage, wherein said actuating means comprises two lateral edges, wherein said cable extends along each of said two lateral edges of said actuating means, wherein said manipulating element comprises two protective enclosure means, each protective enclosure means being positioned along a different lateral edge of said actuating means to individually protect different portions of said cable.

21. A ski boot comprising:

(a) an upper adapted to be placed in an open position for receiving the foot of a skier and a closed, latched position;

(b) a manipulation element; and (c) cable attaching said upper to said manipulation element, wherein said cable comprises means for closing and latching said upper, wherein said manipulation element comprises:

(i) means for actuating said cable to close and latch said upper, wherein said actuating means is attached to said upper and said cable is attached to said actuating means; and (ii) at least one protective enclosure means attached to said actuating means for at least partially enclosing said cable along at least a portion of the length of said cable to protect said cable from damage, wherein said at least one protective enclosure means is journalled on said actuating means, and wherein said boot further comprises elastic means for biasing said at least one protective enclosure means toward said actuating means.

22. The boot defined by claim 21 wherein said actuating means comprises a lever having a first end and a second end, wherein said first end is journalled on said upper.

23. The boot defined by claims 22 wherein said at least one protective enclosure means is journalled on said second end of said lever.

24. The boot defined by claim 23 wherein said elastic means comprises a return spring for biasing said protective enclosure means toward said lever.

25. The boot defined by claim 24 further comprising:

(d) a shell base around which said upper is at least partially journalled, wherein said upper comprises:

(i) a cuff; and (ii) a rear spoiler, wherein said rear spoiler is journalled around a transverse axis with respect to said shell base, wherein said first end of said lever comprises an upper end journalled on said rear spoiler.

26. The boot defined by claim 25 wherein said rear spoiler is adapted to be positioned in an open position for receiving the foot of a skier and said rear spoiler is adapted to be positioned in a latched and closed position in which said rear spoiler is latched on said cuff and around the lower leg of said skier.

27. The boot defined by claim 26 further comprising two lateral anchors each positioned on different lateral sides of said cuff, wherein each anchor anchors one end of said cable to said cuff, wherein said spoiler comprises a guide for guiding said cable from said anchors to said manipulation element, wherein said lever comprises an lower end, wherein said cable is attached to said lower end of said lever.

28. The boot defined by claim 27 wherein at least a portion of said at least one protective enclosure means is generally horseshoe-shaped wherein said at least a portion of said at least one protective enclosure means comprises two spaced apart arms spaced apart by a distance sufficient to accommodate said cable between said arms.

29. The boot defined by claim 28 wherein each of said arms comprises an end, wherein said at least one protective enclosure means is adapted to be positioned in a closed position in which said ends of said arms contact on the surface of said lever.

30. The boot defined by claim 29 wherein the portion of said surface of said lever in contact with said ends of said arms of said at least one protective enclosure means is bevelled and wherein said ends of said arms of said at least one protective enclosure means are bevelled so that said portion of said surface of said lever and said ends of said arms of said at least one protective enclosure means comprise means for guiding and positioning said ends of said arms into contact with said bevelled portion of said surface of said lever.

31. The boot defined by claim 30 wherein said spoiler comprises a ramp, wherein said at least one protective enclosure means is adapted to be positioned in an open position, wherein said at least one protective enclosure means comprises a bevelled end comprising means for sliding on said ramp when said at least one protective enclosure means in said open position.

32. The boot defined by claim 31 wherein said at least one protective enclosure means comprises a first end and a second end, wherein said first end comprises said bevelled end, and wherein said at least one protective enclosure means is journalled on said lever at said second end.

33. The boot defined by claim 32 wherein said lever comprises two lateral edges, wherein said cable extends along each of said two lateral edges of said lever wherein said manipulation element comprises two protective enclosure means, each protective enclosure means being positioned along a different lateral edge of said lever to individually protect different portions of said cable.

34. A protective enclosure for protecting a cable adapted to close and latch a spoiler of an upper of a ski boot on a lower leg of a skier, wherein said cable closes and latches said spoiler onto said lower leg of said skier in response to closing of a manipulation lever on said spoiler, wherein said cable is attached to said spoiler and is attached to said manipulation lever at an attachment point, wherein said protective enclosure comprises:

(a) means for at least partially enclosing at least a portion of said cable extending between said spoiler and said attachment point to said manipulation lever;

(b) means for journalling said enclosing means on said manipulation lever; and (c) means for biasing said enclosing means toward said manipulation lever.

35. The protective enclosure defined by claim 34 wherein at least a portion of said enclosing means is generally U-shaped and comprises two spaced apart arms for receiving said cable therebetween.

36. The protective enclosure defined by claim 35 wherein said manipulation element comprises a surface, wherein said two spaced apart arms each comprise an end, wherein said enclosing means is adapted to be positioned in a closed position in which said ends of said two spaced apart arms contact said surface of said manipulation element.

37. The protective enclosure defined by claim 36 wherein a portion of said surface of said manipulation element is bevelled and wherein said ends of said two spaced apart arms are bevelled so as to comprise means for positioning and guiding said ends of said two spaced apart arms onto said bevelled portion of said surface of said manipulation element.

38. The protective enclosure defined by claim 37 said manipulation lever comprises a first end and a second end, wherein said first end of said manipulation lever is journalled on said rear spoiler and wherein said journalling means is attached to said manipulation lever at said second end of said manipulation lever.

39. The protective enclosure defined by claim 38 wherein said enclosing means comprises first and second ends, wherein said journalling means is attached to said first end of said enclosing means.

40. The protective enclosure defined by claim 39 wherein said spoiler comprises a ramp, wherein said second end of said enclosing means is bevelled, and wherein said enclosing means is adapted to be placed in an open position in which said bevelled second end of said enclosing means contacts said ramp.

41. The protective enclosure defined by claim 40 in combination with a substantially identical protective enclosure, wherein said manipulation lever comprises two lateral sides along which said cable extends, wherein said two protective enclosures are each positioned along said different lateral sides of said manipulation lever for individually protecting different portion of said cable.

* * * * *

UNITED STATES PATENT AND TRADEMARK OFFICE

CERTIFICATE OF CORRECTION

PATENT NO. : 4,644,670

DATED : February 24, 1987

INVENTOR(S) : Jean-Claude ROCHARD et al.

It is certified that error appears in the above-identified patent and that said Letters Patent is hereby corrected as shown below:

At column 2, line 36, change "rests" to ---rest--- so that it reads, "the ends of the arms rest".

At column 8, line 35, change "ilustrates" to ---illustrates---.

At column 9, line 66, change "claims" to ---claim---.

At column 10 line 24, change "an" to ---a--- so that it reads "comprises a lower end".

At column 11, line 54, change "claims" to ---claim---.

At column 11, line 61, change "(d)" to ---(a)---.

At column 12, line 12 the printed patent, change "an" to ---a--- so that it reads "comprises a lower end".

At column 13, line 9, change "spaced apart" to ---spaced-apart---.

At column 13 lines 13 and 17, change "spaced apart" to ---spaced-apart---.

At column 13, lines 22 and 24, change "spaced apart" to ---spaced-apart---.

Signed and Sealed this

Twenty-fourth Day of January, 1989

*Attest:*

DONALD J. QUIGG

*Attesting Officer*

*Commissioner of Patents and Trademarks*